US006796748B1

(12) United States Patent
Sperber

(10) Patent No.: US 6,796,748 B1
(45) Date of Patent: Sep. 28, 2004

(54) INDEPENDENTLY CONTROLLABLE MULTI-OUTPUT INSULATION BLOWING MACHINE

(75) Inventor: Henry Sperber, Englewood, CO (US)

(73) Assignee: CertainTeed Corporation, Valley Forge, PA (US)

( * ) Notice: Subject to any disclaimer, the term of this patent is extended or adjusted under 35 U.S.C. 154(b) by 106 days.

(21) Appl. No.: 10/204,819

(22) PCT Filed: Aug. 7, 2000

(86) PCT No.: PCT/US00/40592

§ 371 (c)(1),
(2), (4) Date: Aug. 22, 2002

(87) PCT Pub. No.: WO01/10757

PCT Pub. Date: Feb. 15, 2001

Related U.S. Application Data

(60) Provisional application No. 60/147,957, filed on Aug. 9, 1999.

(51) Int. Cl.[7] ..... B65G 53/40

(52) U.S. Cl. ..... 406/123; 406/59; 406/64; 222/636

(58) Field of Search ..... 406/56, 57, 58, 406/59, 64, 123; 222/636

(56) References Cited

U.S. PATENT DOCUMENTS 2,194,487 A * 3/1940 Thompson ..... 406/129
2,532,351 A * 12/1950 Wedebrock ..... 406/61
2,995,404 A * 8/1961 Bodner ..... 406/123
3,596,805 A * 8/1971 Farmery ..... 406/42
3,712,681 A * 1/1973 Marino et al. ..... 406/48
3,861,599 A * 1/1975 Waggoner ..... 239/654
4,037,758 A * 7/1977 Bourque ..... 222/134
4,111,493 A * 9/1978 Sperber ..... 406/64
4,236,654 A * 12/1980 Mello ..... 222/238
4,465,239 A * 8/1984 Woten ..... 241/98
4,978,252 A * 12/1990 Sperber ..... 406/64
5,114,281 A * 5/1992 Hartnett et al. ..... 406/39
5,181,804 A * 1/1993 Wysong et al. ..... 406/67
5,190,082 A * 3/1993 Watson et al. ..... 141/1
5,403,128 A * 4/1995 Thomas ..... 406/39
5,590,984 A * 1/1997 Assarsson ..... 406/32
5,647,696 A * 7/1997 Sperber ..... 406/56
5,788,163 A * 8/1998 Woten et al. ..... 358/1.14
5,795,108 A * 8/1998 Lightle ..... 406/48
5,829,649 A * 11/1998 Horton ..... 222/636
6,045,298 A * 4/2000 Lytle ..... 406/48
6,109,488 A * 8/2000 Horton ..... 222/636
6,161,784 A * 12/2000 Horton ..... 239/654

* cited by examiner

*Primary Examiner*—Joe Dillon, Jr.
(74) *Attorney, Agent, or Firm*—Stevens, Davis, Miller & Mosher, LLP

(57) ABSTRACT

A single machine (20) for blowing insulation into cavities of buildings and methods of using the machine to deliver insulation are provided. The single machine includes at least one engine (100), a hopper assembly (74), two feeding assemblies (36, 40) each operably connected to an output hose (76, 80), two air blowing assemblies (84, 88) each connected to feeder assemblies. The single machine can independently and simultaneously deliver insulation through multiple output hoses to same cavity of different cavities.

17 Claims, 8 Drawing Sheets

INDEPENDENTLY CONTROLLABLE MULTI-OUTPUT INSULATION BLOWING MACHINE

This application claims the benefit of Provisional application Ser. No. 60/147,957, filed Aug. 9, 1999.

FIELD OF THE INVENTION

The present invention relates to a single apparatus having multiple outputs that are independently controllable for delivering insulation.

BACKGROUND OF THE INVENTION

The benefits of adding insulation into areas or cavities of a building, particularly homes, are well recognized. Typically, insulation is blown into walls, attics and other cavities with a single output machine having one output hose as described, for example, in U.S. Pat. No. 4,111,493 issued Sep. 5, 1978 and entitled "Feeding Apparatus for a Pneumatic Conveying System," and U.S. Pat. No. 5,647,696 issued Jul. 15, 1997 and entitled "Loose Material Combining and Depositing Apparatus." The machine is usually transported in a truck to a work site. Once there, an installer must move the machine around the building to reach all the cavities to be insulated. This process, however, can be time-consuming and not as productive as may be desirable. Therefore, it would be advantageous to have a single apparatus capable of delivering insulation simultaneously to multiple areas at the same work site or capable of substantially increasing the amount of insulation delivered to the same area.

SUMMARY OF THE INVENTION

The present invention provides a method and a single machine for blowing insulation into cavities of buildings, such as behind walls and in attics of homes. The single machine is capable of delivering insulation through multiple hoses operably connected to independently controllable feeder and air blowing assemblies. Although the machine of the present invention is transportable in one truck similar to single output hose machines, it is capable of delivering at least twice as much insulation or the same amount of insulation at significantly greater speed compared to machines having a single output hose.

The single machine of the present invention includes at least one engine, a hopper assembly, at least two feeding assemblies each having an output connected to an output hose, at least two air blowing assemblies each operably connected to a feeder assembly, and connection devices for operatively connecting one or more engines to the feeding assemblies and the air blowing assemblies. Thus, the single machine is capable of independently and simultaneously delivering insulation through multiple output hoses. For example, a first worker can position or maneuver the first hose to fill a wall section or attic cavity with insulation, while a second worker can position the second hose for use in filling another section of the same wall, a section of another wall or different portions of the attic at the same time the first worker is using the first hose. Therefore, installing the insulation can be done in about half the time compared to single output hose machines. Alternatively, an installer can deliver at least twice as much insulation to one area by directing the multiple output hoses to the same area using the single machine of the present invention. This can be achieve, for example, by connecting the multiple output hoses to a single larger hose.

The hopper assembly is preferably larger than those of a single output hose machine since more insulation can be installed using the machine of the present invention. In one embodiment, the hopper assembly includes a first and second hoppers that are in immediate communication with each other and, preferably in a vertical arrangement. Each hopper can also include an auger that moves the insulation material toward the feeding assemblies.

The machines includes at least a first and second feeding assemblies separated by a common wall or otherwise located separately from each other. The feeding assemblies have their own inlets that are in communication with the hopper assembly, preferably with the lower hopper if one exists. The inlets receive the insulation material simultaneously if the feeding assemblies are activated (i.e., operating at the same time). Each of the feeding assemblies contain a number of mechanisms that are arranged vertically to facilitate the downward movement of the insulation material toward its respective outlet, which is located toward the bottom of the feeding assembly. Each outlet is then connected to an output hose that can be directed to a particular area to be insulated.

To force the insulation out of the output hoses, each feeding assembly is connected to an air blowing assembly that outputs a force of air or pressurized air through an air hose to an inlet of the feeding assembly. When the feeding and air blowing assemblies are activated, the insulation material is blown through the respective output hoses to the areas or cavities to be insulated.

The single machine is operated by at least one engine and a number of connection devices that interconnect and operate the major components of the machine. For example, the machine can be operated by a single machine having two output shafts that operate the feeding and air blowing assemblies, as well as the augers in the hoppers, through associated clutch devices, pulleys and belts. Alternatively, two or more engines can be used to operate the moving components of the machine.

Each feeding assembly can be independently operated relative to any other feeding assembly. This independent functioning and operation is achieved, in part, by using a disengage mechanism associated with each feeding assembly. The disengage mechanism operates to disconnect its associated feeding assembly from the hopper drive assembly. Although disconnected from one feeding assembly, the hopper drive assembly, nevertheless, continues to be driven by any other activated feeding assembly. Consequently, each feeding assembly is independently functional of any other feeding assembly so that insulation can be installed using less than all the available output hoses if desired.

The machine also includes various power and control elements, including a battery, that provide electrical power for the machine. A number of control elements are also included through a system of switch control units that control the air blowing assemblies and the rotational movement of various shafts used to operate the augers and other components that drive the movement of the insulation material.

The present invention further provides methods for delivering insulation using the single machine of the present invention. The methods are generally accomplished by:

(a) providing a single machine as described above;

(b) connecting a hose to the output of each feeding assembly to be activated;

(c) loading insulation material into the hopper assembly;

(d) powering at least one engine;

(e) activating any desired air blowing assembly and corresponding feeding assembly; and (f) installing insulation using the output of each activated feeding assembly.

Installing insulation to different areas of a building can be conducted by different workers simultaneously. Alternatively, a disengage mechanism operatively connected to a feeding assembly can be used to deactivate the feeding assembly by disconnecting the feeding assembly from the hopper drive assembly. In this regard, an air blowing assembly and its corresponding feeding assembly can be deactivated while maintaining activation of one or more of the other air blowing assemblies and the corresponding feeding assemblies. Alternatively, one worker can install insulation into the same cavity using both insulation outputs.

DETAILED DESCRIPTION

The present invention relates to blowing insulation into areas or cavities of a building, such as a home. The present invention is a single machine that has two or more outputs from which insulation material is delivered under air pressure to hoses that are connected to the outputs. The single machine having multiple outputs is readily transported to the work site and its size is substantially comparable to the size of a machine having a single output for blowing insulation.

Figure 1:
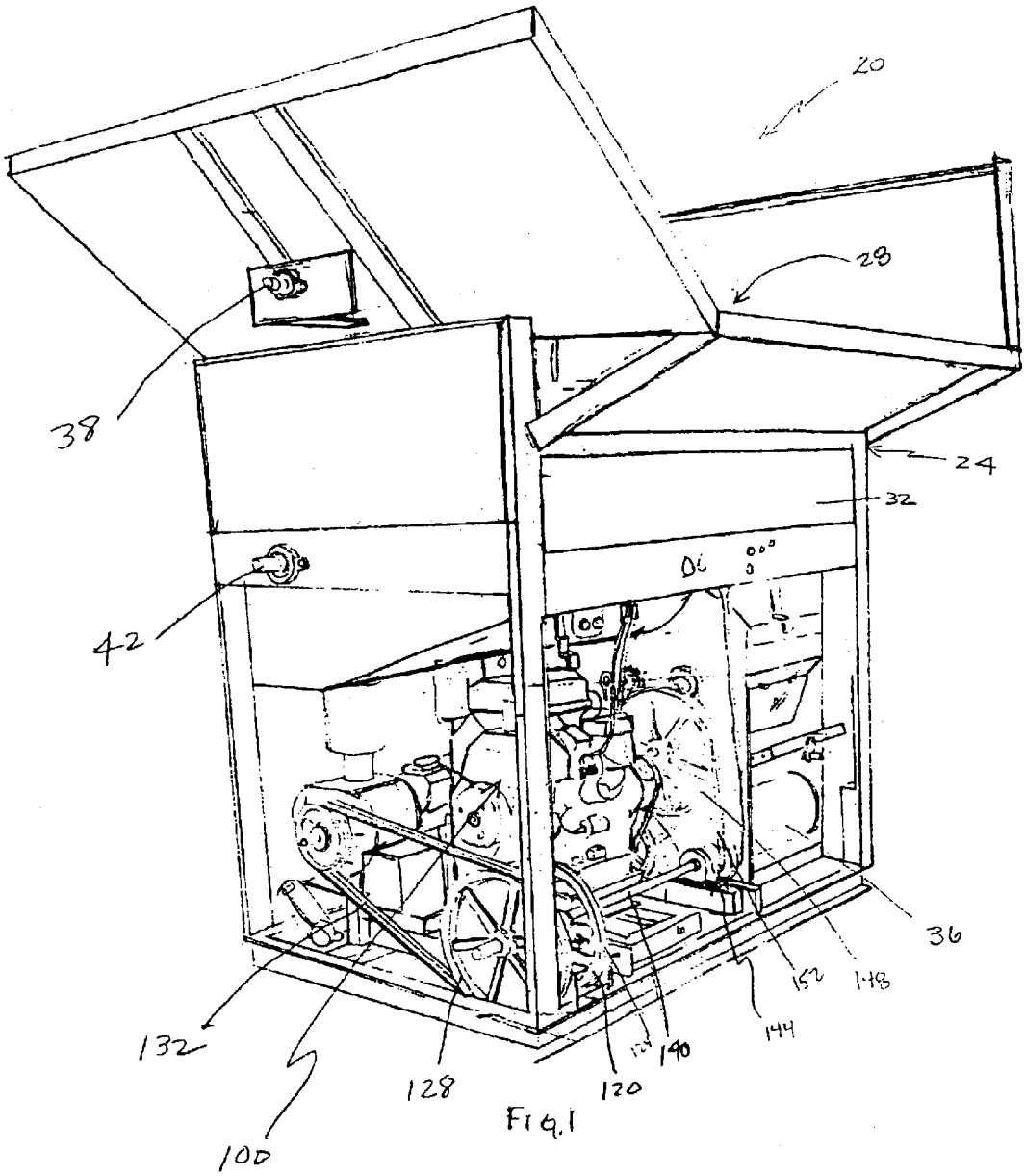
FIG. 1 is a perspective view of the machine of the present invention.
Figure 2:
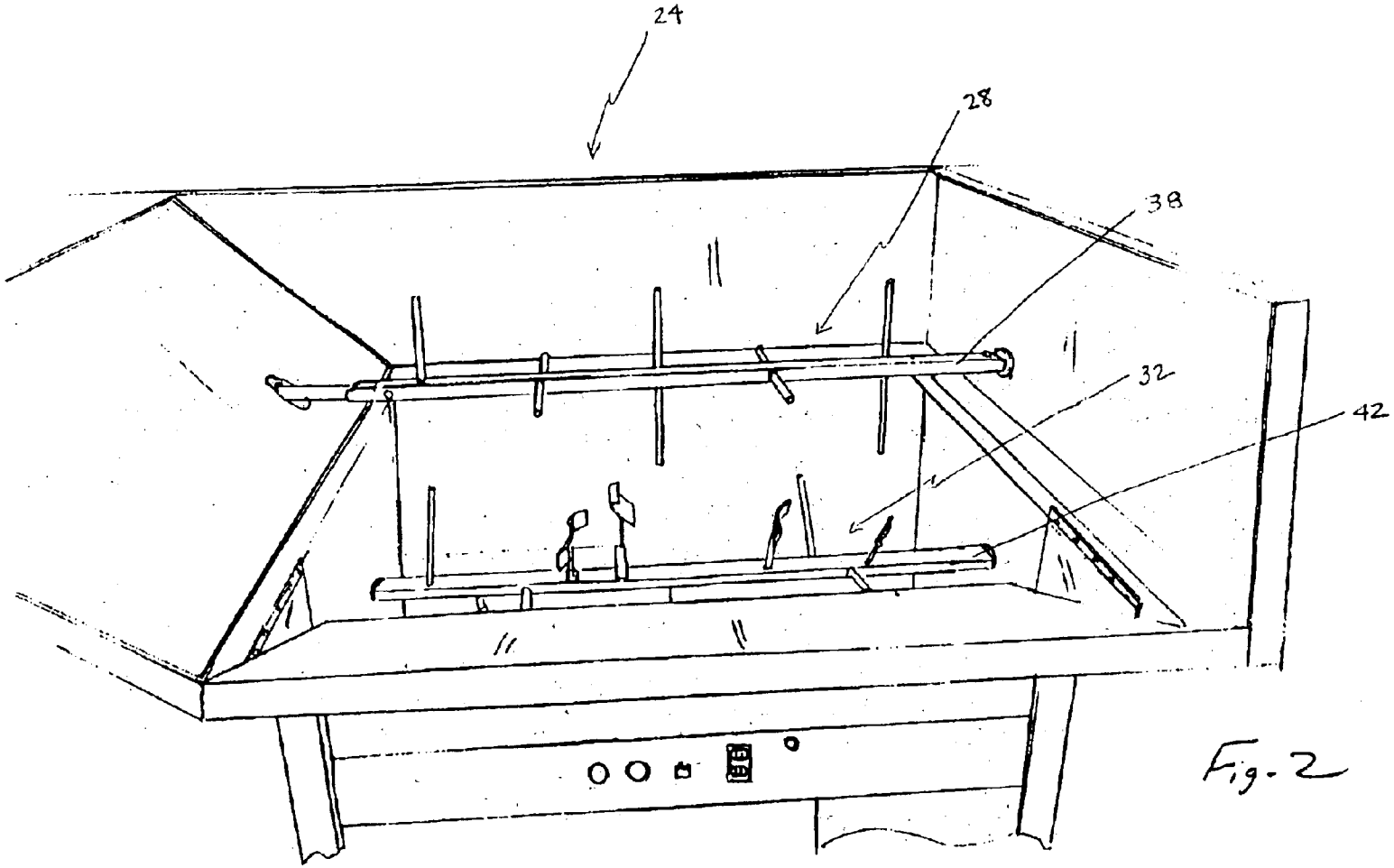
FIG. 2 is a top view of the machine showing the upper and lower augers located in the upper and lower hoppers.

With reference to FIG. 1, the single machine 20 includes a hopper assembly 24 that receives and contains insulation material that is to be blown into the sections of the building that are being insulated. Preferably, the hopper assembly 24 has greater dimensions and size than a single output machine since more insulation material can be handled or blown into the building cavities because two output hoses are being utilized. In one embodiment, the hopper assembly 24 can be defined as including an upper or first hopper 28 and lower or second hopper 32 that is in immediate communication with the upper hopper 28, while being located vertically below it. In one embodiment best shown in FIG. 2, the upper hopper 28 includes a first auger 38 and the lower hopper 32 includes a second auger 42. The first and second augers 38, 42 are driven to rotate and carry insulation material along a path that eventually leads to outputting the insulation material.

Figure 4:
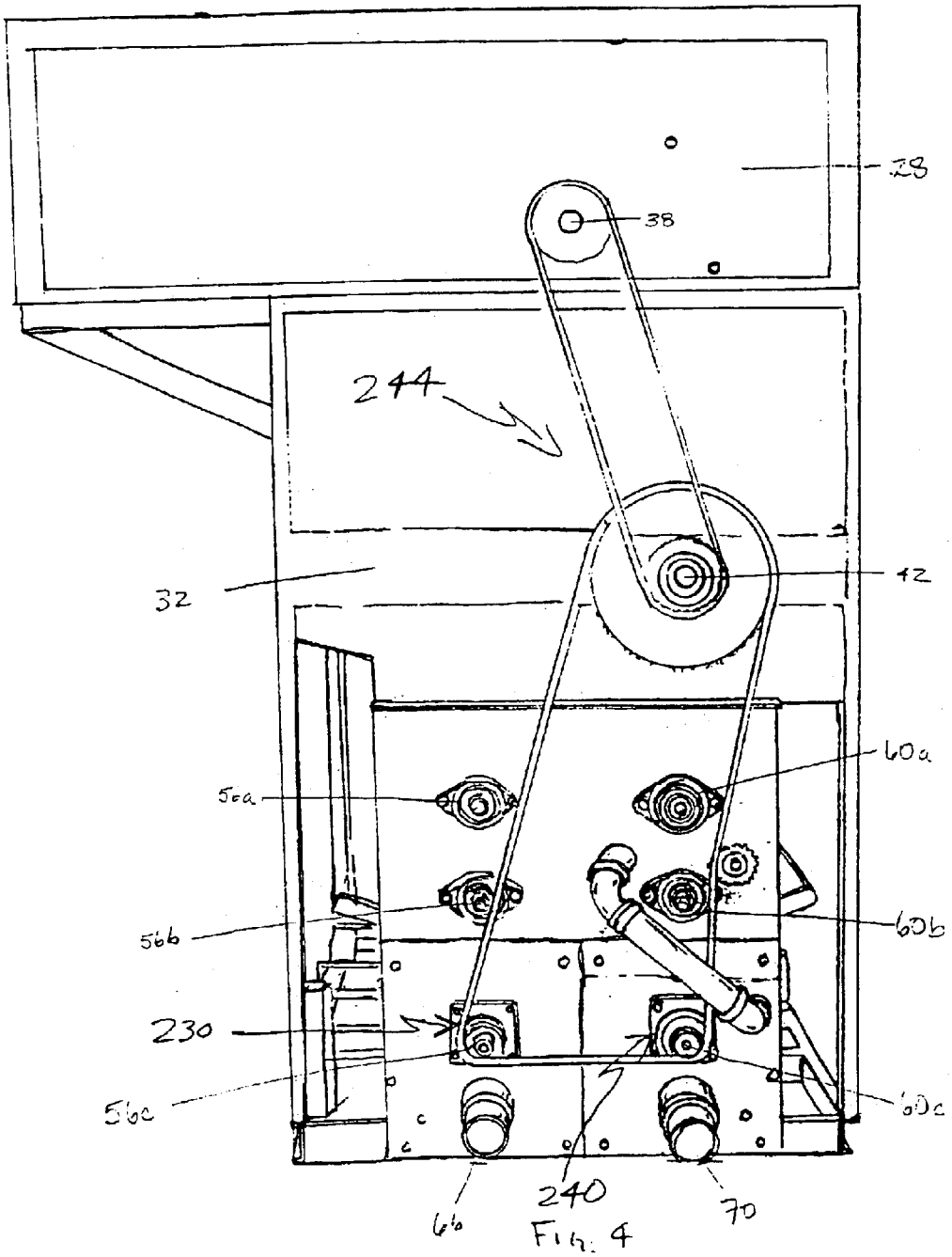
FIG. 4 is a side view of the machine showing the insulation outputs and the shafts of the feeding assemblies.
Figure 5:
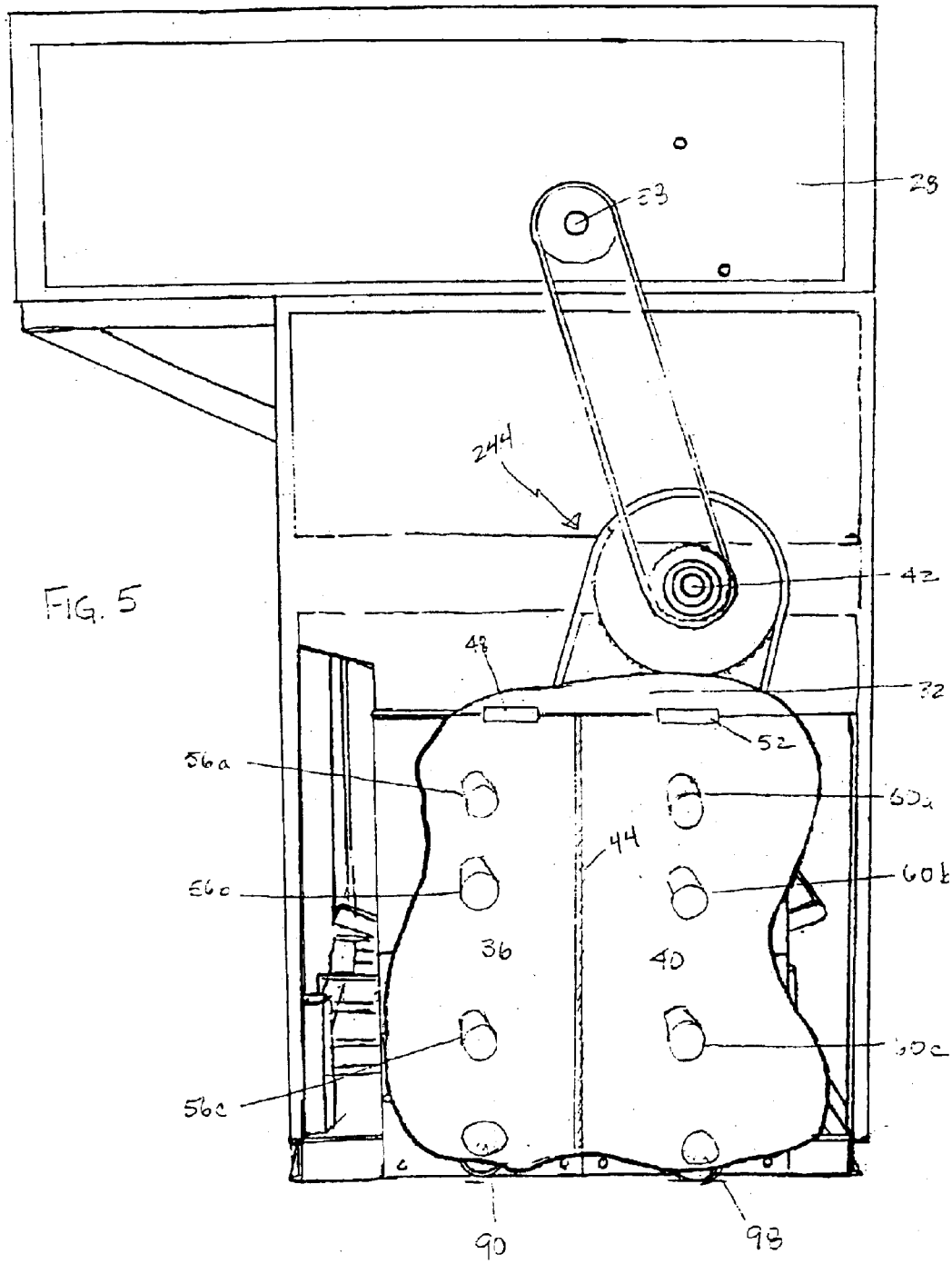
FIG. 5 is a cut-away section of FIG. 4 showing the first and second feeding assemblies, the insulation inlets, the common wall, and the inlets for the first and second air hoses.

With regard to movement of the insulation from the hopper assembly 24, the single machine includes a first feeding assembly 36 and a second feeding assembly 40 best seen in FIG. 5. Preferably, a common wall 44 can be positioned between the two feeding assemblies 36, 40, although they could be located separately from each other, e.g., at opposite ends on the machine 20. The first feeding assembly 36 has a first inlet 48 and the second feeding assembly 40 has a second inlet 52. Each of these first and second inlets 48, 52 is in communication with the bottom of the lower hopper 32. Consequently, as the fist and second augers 38, 42 move the insulation material towards the end portion of the hopper assembly 24 having the first and second feeding assemblies 36, 40 located there below, these two inlets 48, 52 receive insulation material at the same time, particularly when the first and second feeding assemblies 36, 40 are activated or being operated. In one embodiment, the components and arrangement thereof for the second feeding assembly 40 is the same as that of the first feeding assembly 36. Consequently, a more detailed description will be provided regarding the first feeding assembly 36, with the understanding that such description also applies to the second feeding assembly 40. In an exemplary embodiment, the first feeding assembly 36 includes a number of conveying or moving mechanisms, such as one or more tines, that are arranged vertically relative to each other and each of which has a movable shaft. As shown in FIGS. 4 and 5, the first feeding assembly 36 has three moving mechanisms with shafts 56*a*, 56*b*, 56*c*. As insulation material is moved and positioned beneath the first feeding assembly 36, the moving mechanisms thereof, when rotated cause or facilitate downward movement of the insulation material. Similarly, the second feeding assembly 40 has the same number of moving mechanisms with shafts 60*a*, 60*b*, 60*c*. For more information concerning the moving assemblies of the first and second feeding assemblies 36, 40, reference is made to U.S. Pat. No. 5,647,696 issued Jul. 15, 1997, "Loose Material Combining And Depositing Apparatus" and U.S. Pat. No. 4,111,493 issued Sep. 5, 1978, "Feeding Apparatus For A Pneumatic Conveyance System", both of which are assigned to the same inventor as the present application.

Figure 6:
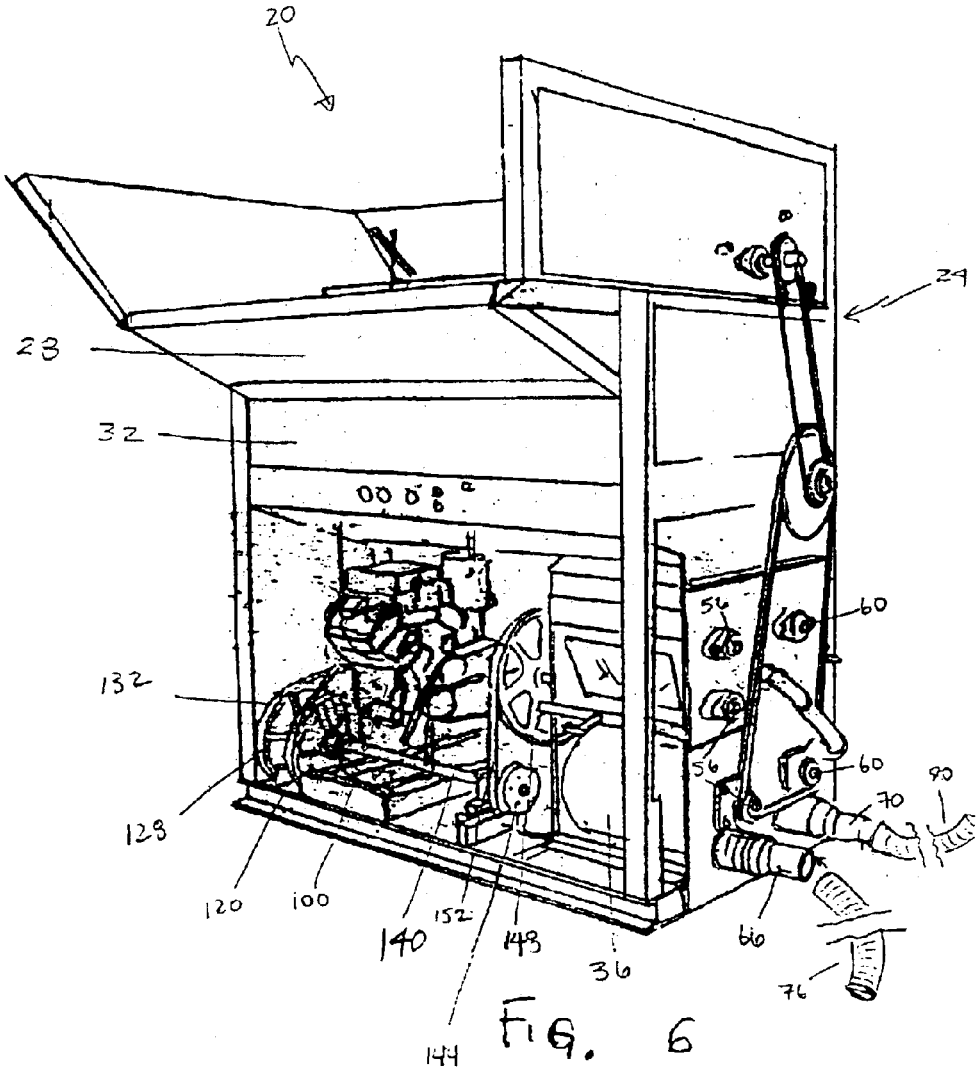
FIG. 6 is a perspective view of the machine taken from the opposite side of FIG. 1.
Figure 7:
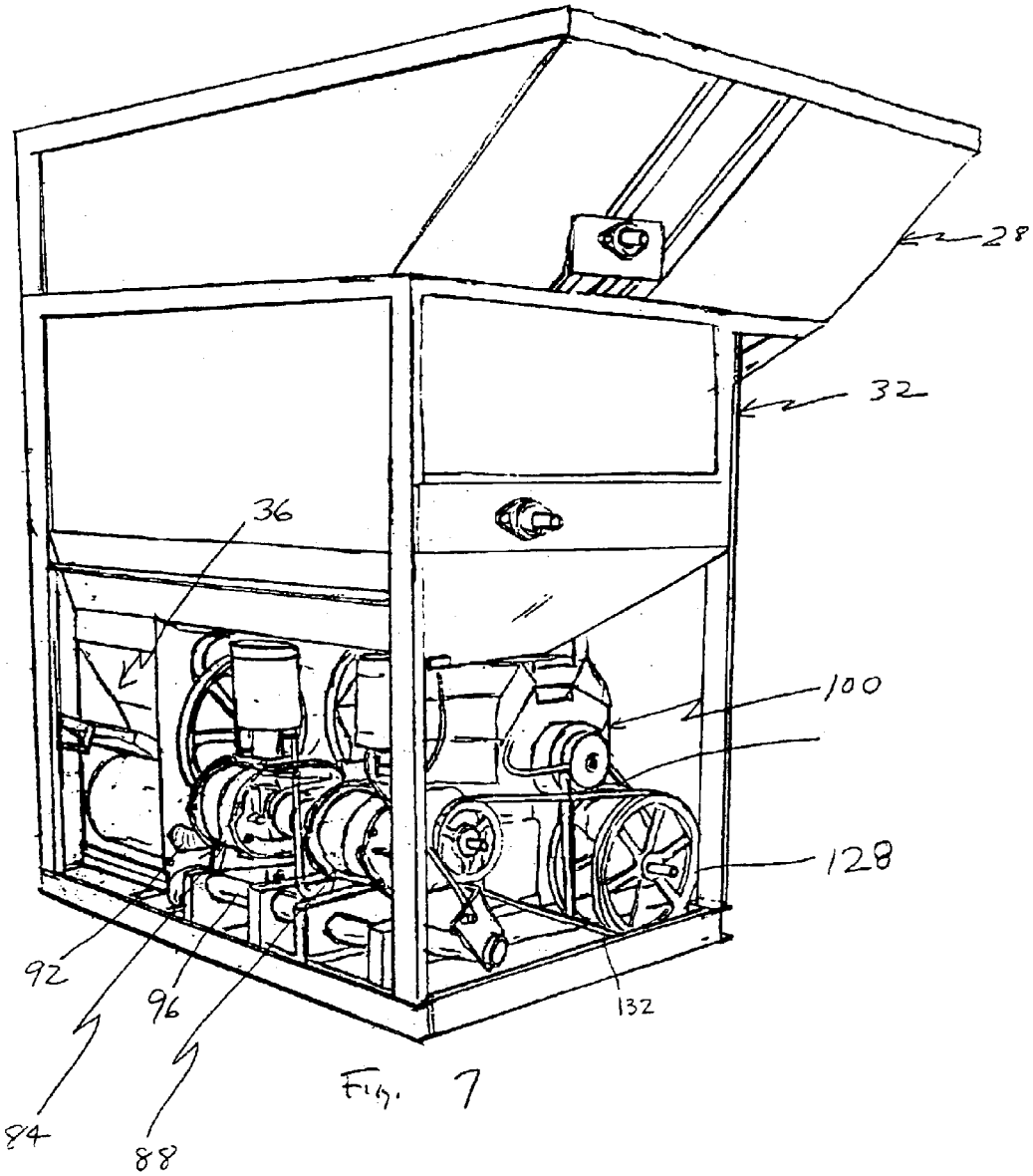
FIG. 7 is a perspective view of the machine from its band end.
Figure 8:
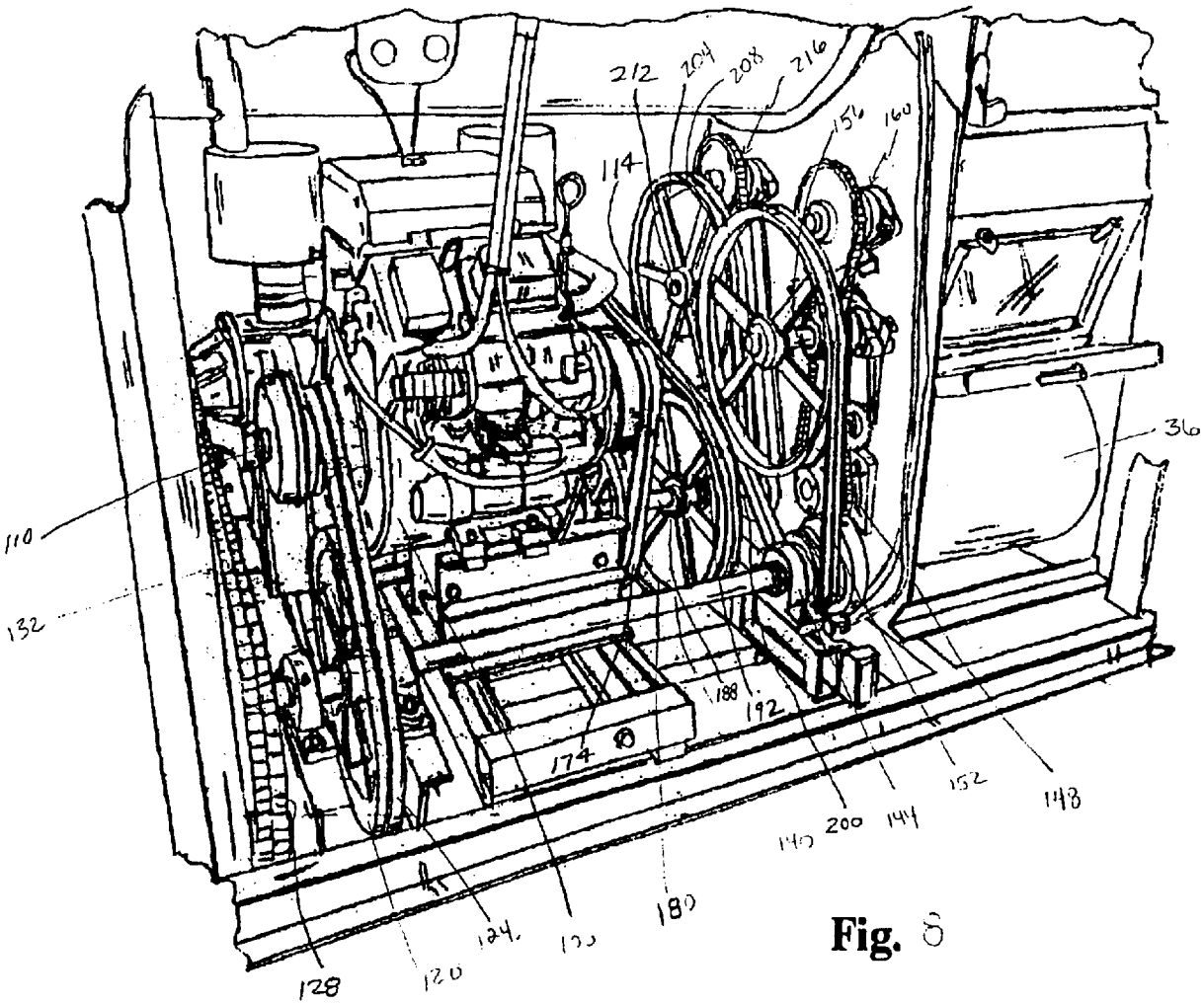
FIG. 8 is a perspective view of the machine of FIG. 1 with its upper parts cutaway.
Figure 1:
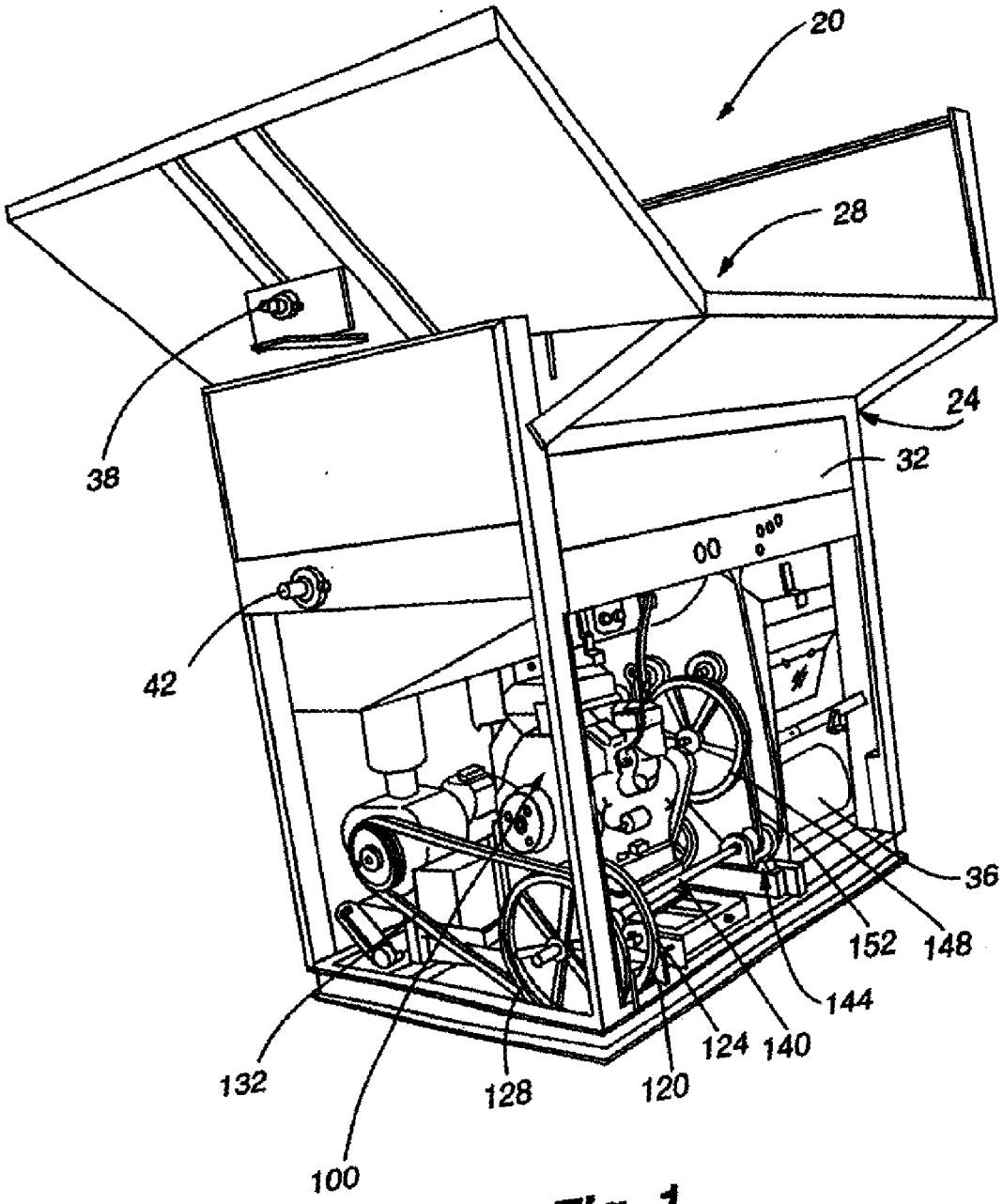
Figure 2:
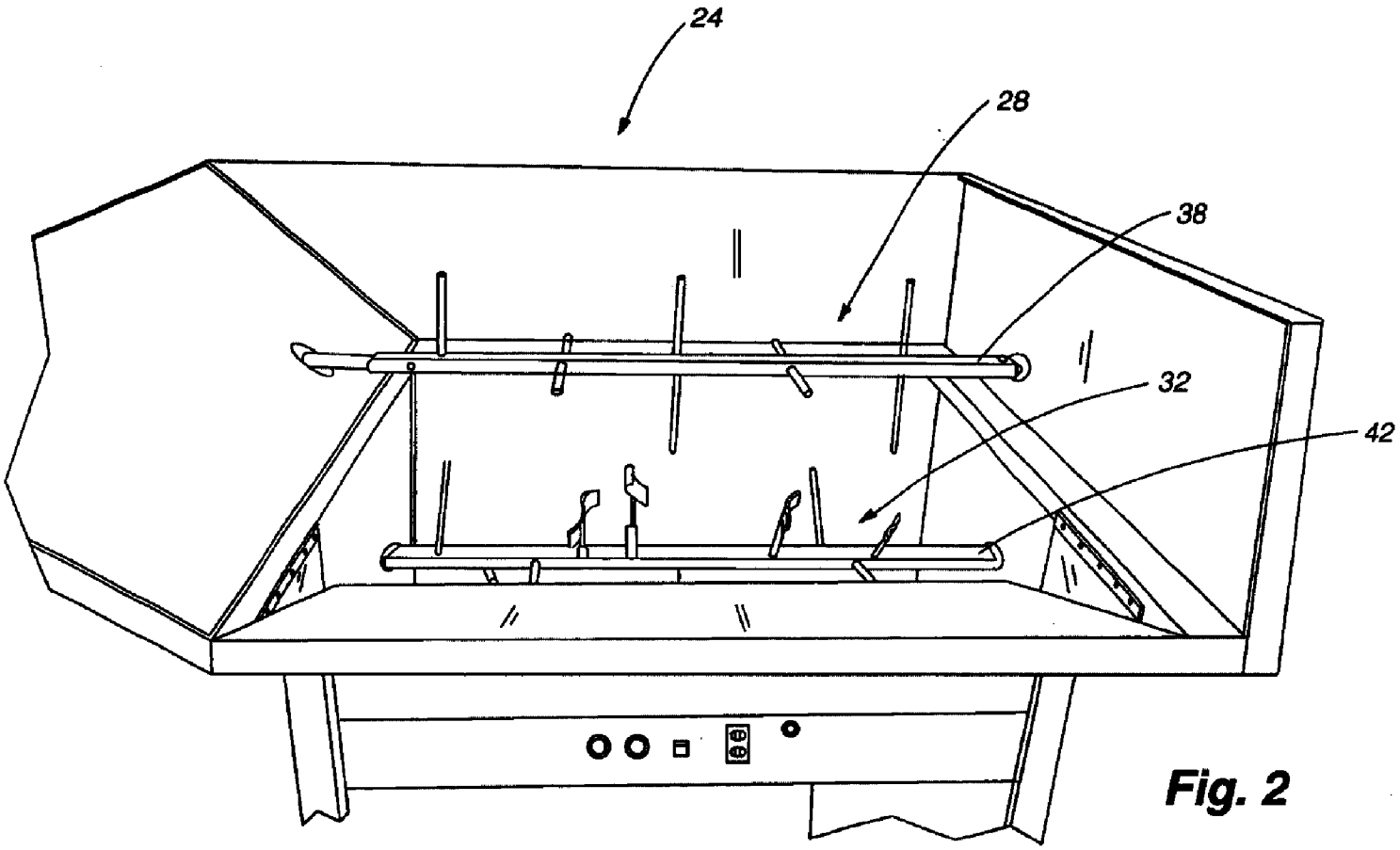
Figure 3:
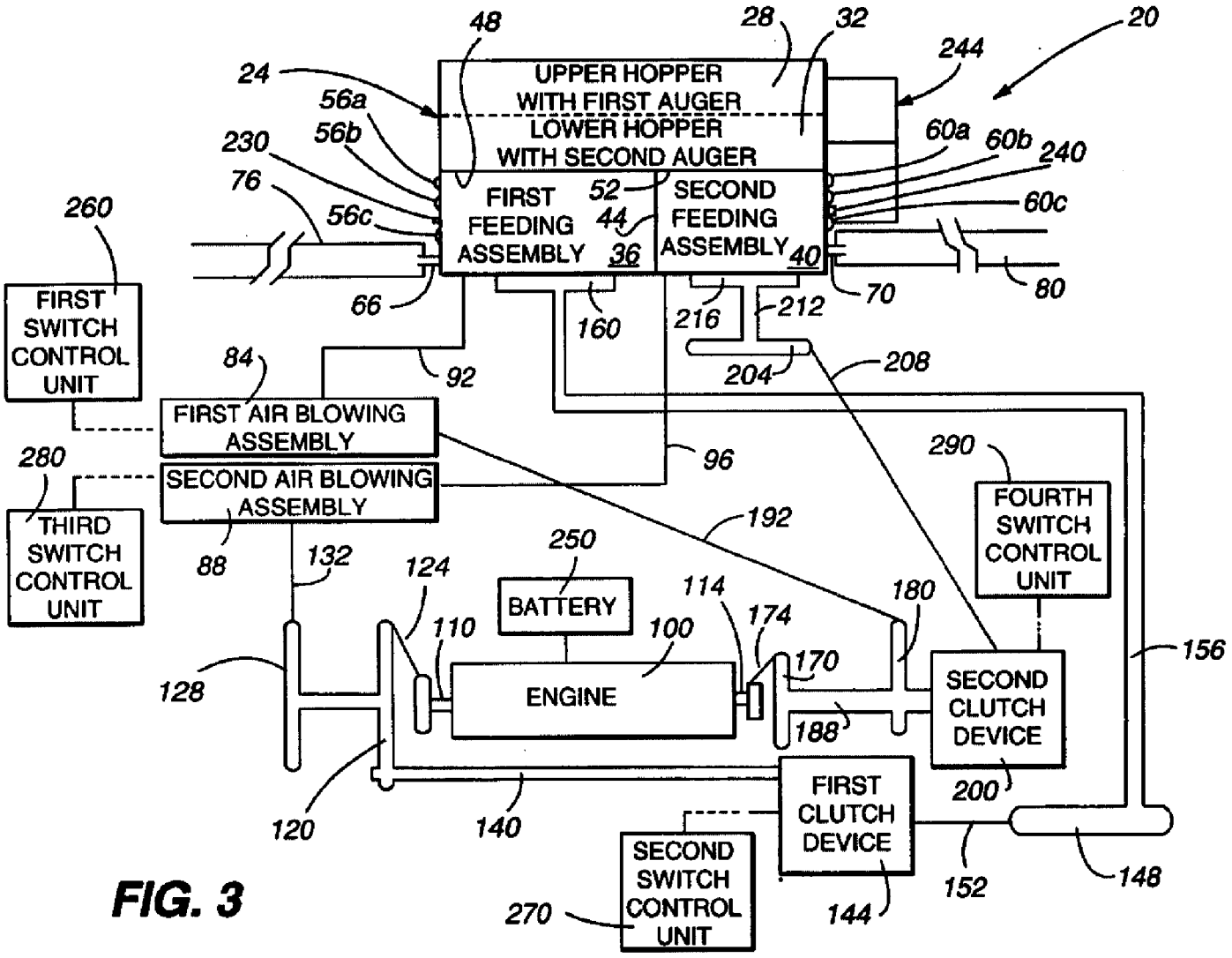
Figure 4:
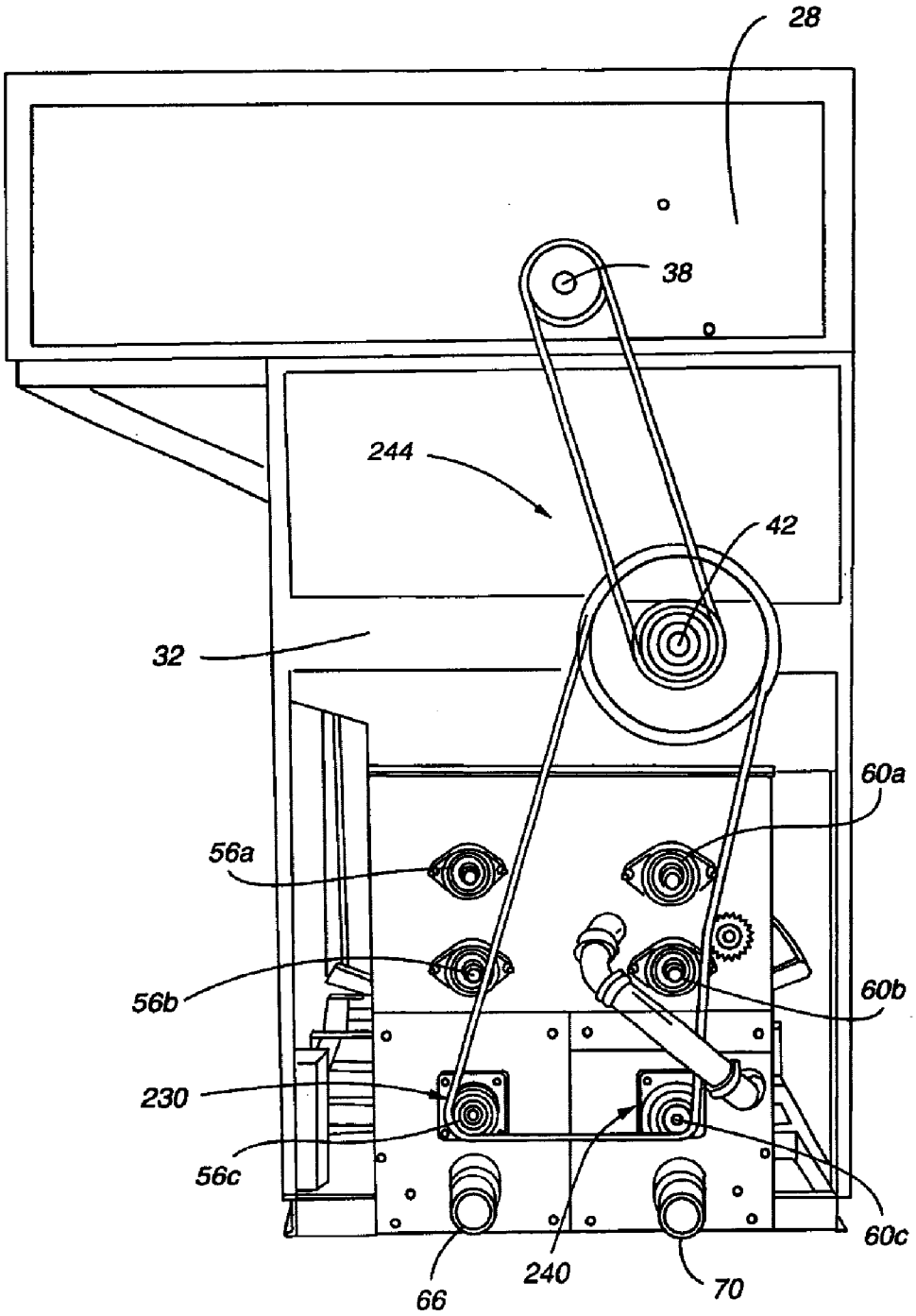
Figure 5:
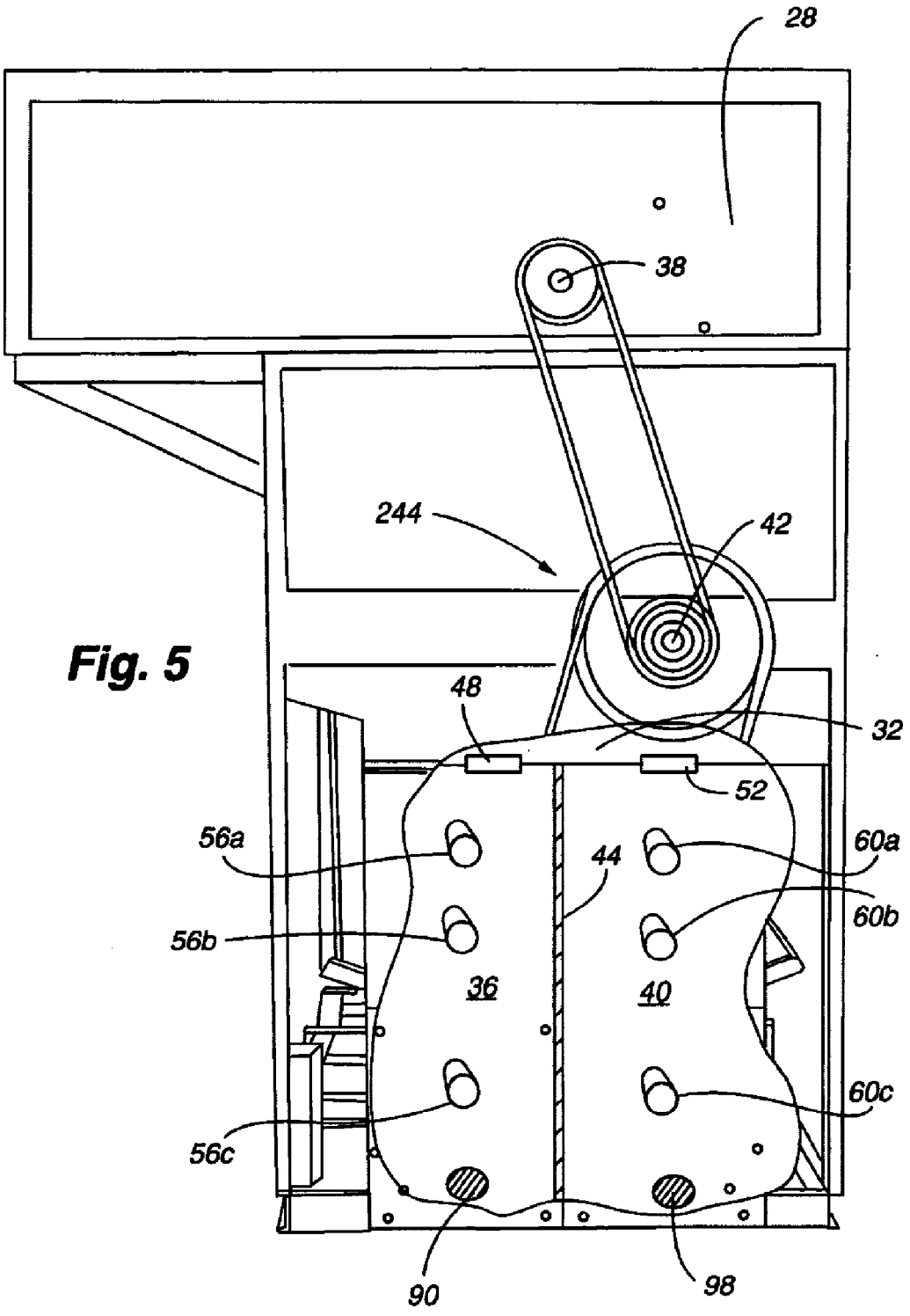
Figure 6:
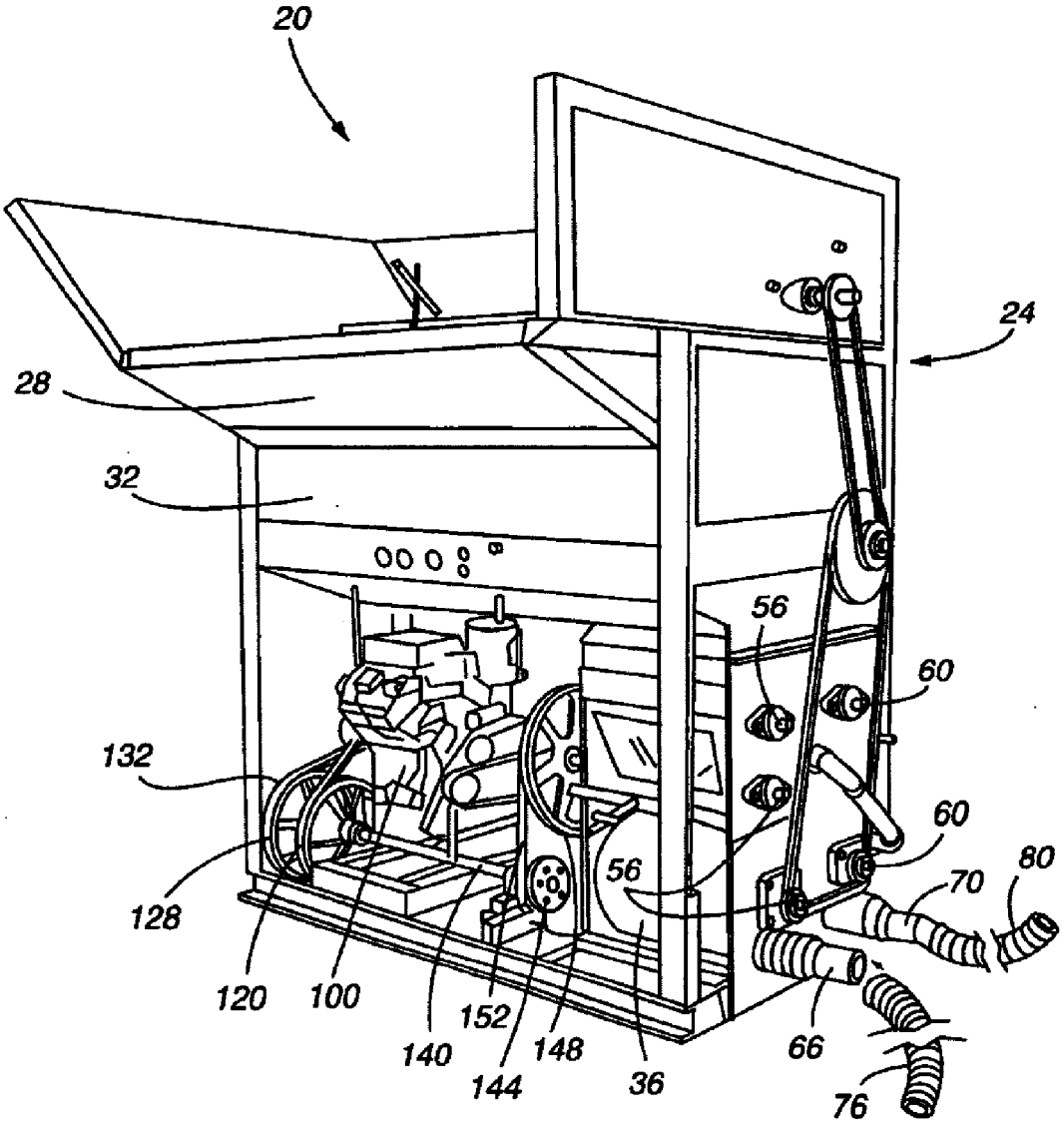
Figure 7:
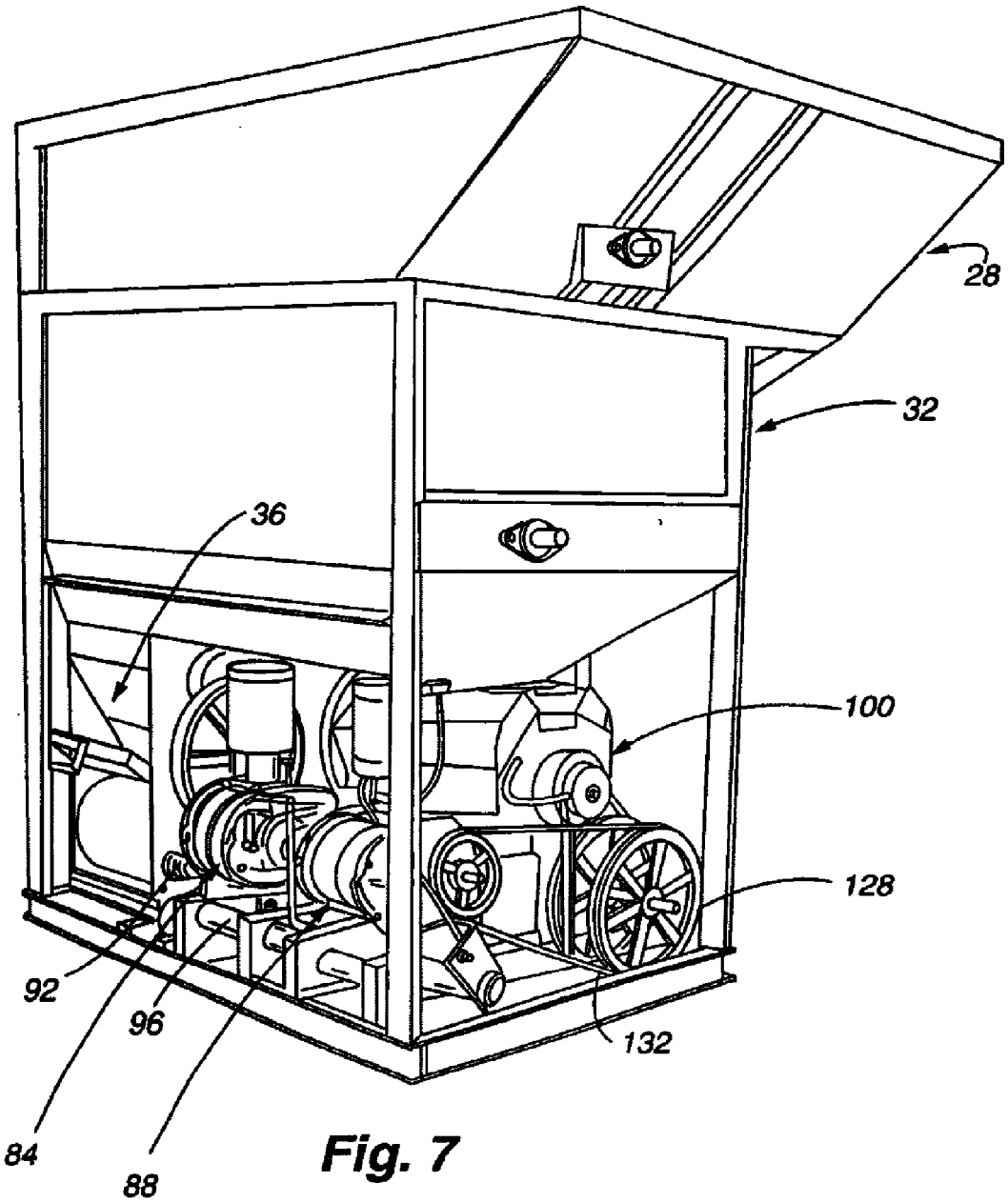
Figure 8:
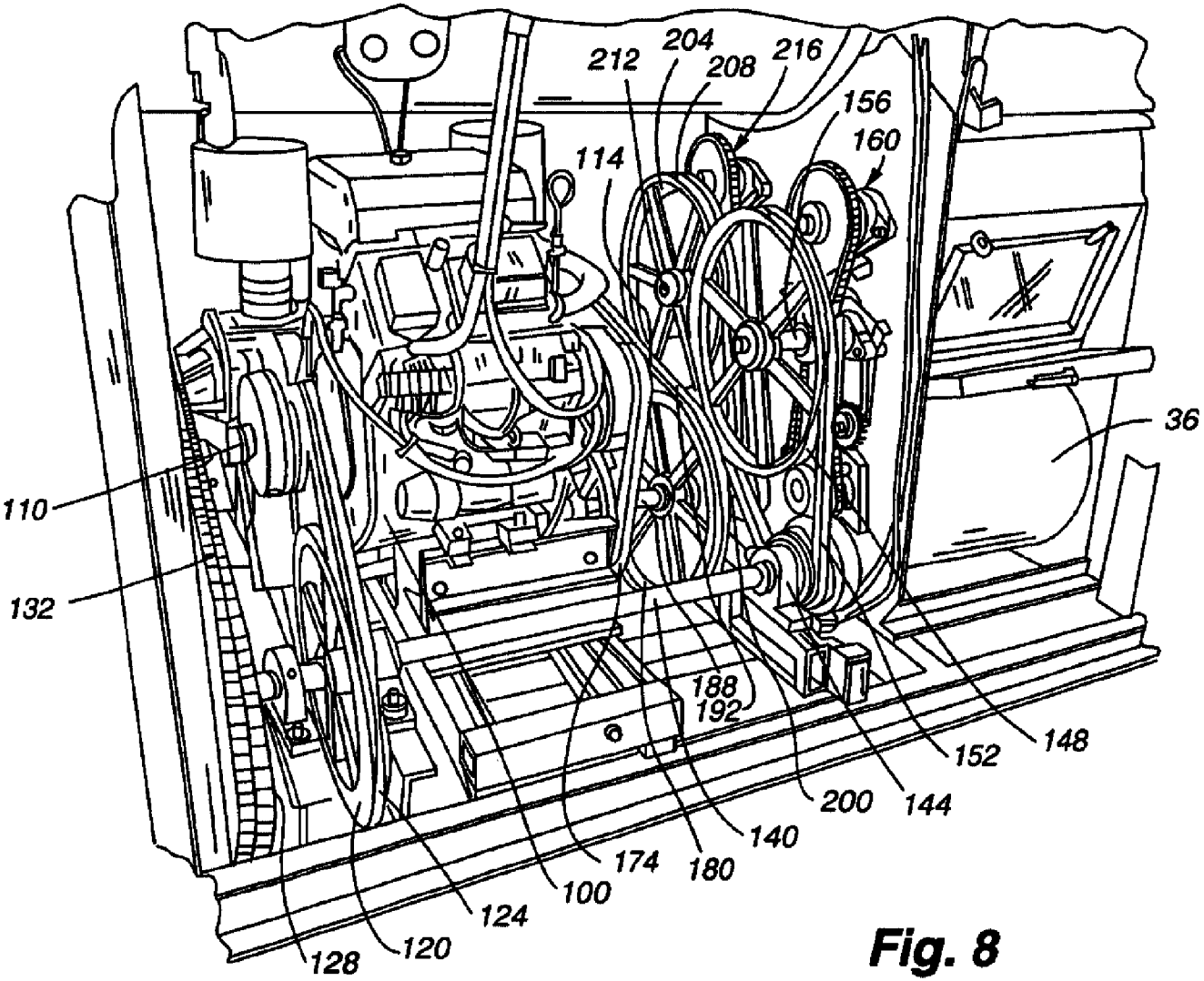

As shown in FIG. 4, the first feeding assembly 36 has a first output 66 and the second feeding assembly 40 has a second output 70. These are located adjacent to bottoms of the first and second feeding assemblies 36, 40, respectively. With reference to FIG. 6, the first output 66 is connected to a first output hose 76 and the second output 70 is connected to a second output hose 80. As an example, when the single machine 20 is being operated or used by two workers, the first and second output hoses 76, 80 can carry the insulation material to different parts of the building that is being insulated. In conjunction with moving the insulation from the first and second feeding assemblies 36, 40 through the first and second hoses 76, 80, respectively, the single machine also includes a first air blowing assembly 84 and a second air blowing assembly 88, which are depicted in the block diagram of FIG. 3. The first and second air blowing assemblies 84, 88 each output a force of air or pressurized air that is carried to the first feeding assembly 36 and second feeding assembly 40, respectively. That is, the first air hose 92 carries the pressurized air to an inlet 90 of the first feeding assembly 36, while the second air hose 96 carries the pressurized air to an inlet 98 of the second feeding assembly 40, with these inlets 90, 98 being illustrated in FIG. 5. When the first and second air blowing assemblies 84, 88 are providing pressurized air and the first and second feeding assemblies 36, 40 are activated and are receiving and carrying insulation material, the insulation material is blown through the respective first and second output hoses 76, 80 to the areas or cavities being filled with insulation.

Figure 3:
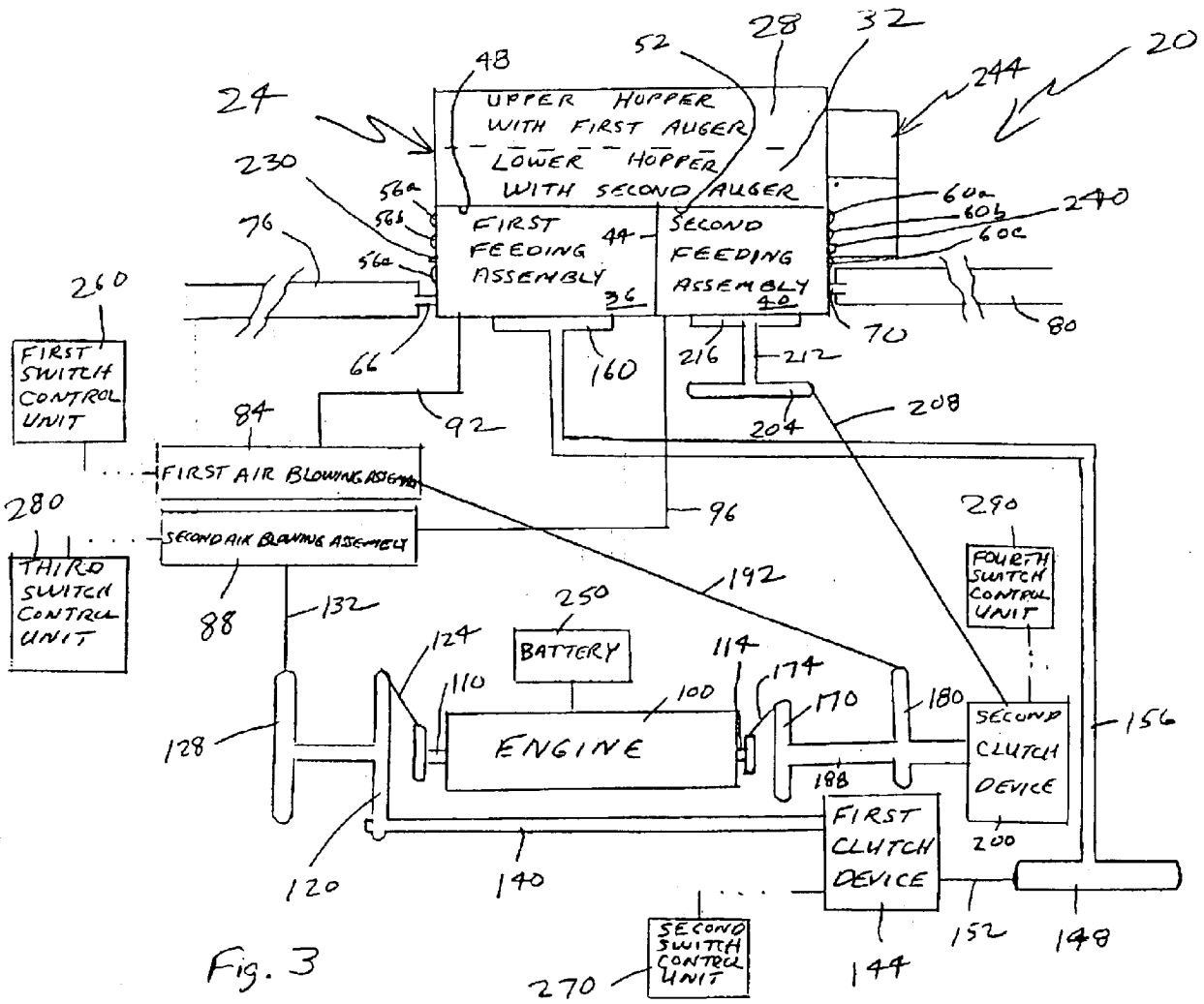
FIG. 3 is a block diagram of the major components of the machine.

With respect to operating the machine 20 and referring to the block diagram or diagrammatic representation of FIG. 3, it includes an engine 100 and a number of connection parts used in interconnecting and in operations associated with the major components of the machine 20. In the exemplary embodiment, the engine 100 is a single engine having a first output shaft 110 and a second output shaft 114. It should be appreciated that, instead of a single engine, two engines could be provided, with each having its own separate output shaft. As seen in FIG. 3, the first output shaft 110 is connected to an engine first pulley 120. A first output shaft belt 124 is operably associated with the first output shaft 110 and the engine first pulley 120. Interconnected to the engine first pulley 120 is a second air blowing pulley 128, which has a belt 132 associated therewith. The second air blowing belt 132 is operably connected to the second air blowing assembly 88 and provides a rotational input for its operation. The engine first pulley 120 is also operably connected to a first main shaft 140 that extends in a direction along the length of the engine 100 to a first clutch device 144, which selectively operably interacts with a first feeding assembly pulley 148 through the linkage including a first feeding assembly belt 152. The first feeding assembly pulley 148 is connected to a first input shaft 156 that is engaged with a first feeding assembly drive mechanism 160. Hence, engine power is selectively supplied using these components to the first feeding assembly drive mechanism 160 rotating or causing movement of the moving or conveying assemblies thereof.

Returning to the second output shaft 114 of the engine 100, it is connected to an engine second pulley 170 using a second output shaft belt 174. The engine second pulley 170 is joined to a fist air blowing pulley 180 using a second main shaft 188. The first air blowing pulley 180 is operably connected to the first air blowing assembly 84 by means of a first air blowing belt 192. The rotational movement of the first air blowing belt 192, by being coupled to the first air blowing assembly 84, functions to operate the first air blowing assembly 84 in connection with its output of pressurized air to the first feeding assembly 36. The second main shaft 188 exits the first air blowing pulley 180 and is coupled to a second clutch device 200 that is used in selectively coupling the rotational movement of the second main shaft 188 to a second feeding assembly pulley 204 by means of a second feeding assembly belt 208. The second feeding assembly pulley 204 is joined to a second input shaft 212 that is operably interconnected with a second feeding assembly drive mechanism 216. Consequently, when activated, the second feeding assembly drive mechanism 216 causes rotational movement of the moving or conveying mechanisms of the second feeding assembly thereby causing or facilitating movement of the insulation material in a downward direction towards the second output 70.

A key aspect of the single machine 20 involves the ability to simultaneously fill different areas or cavities of a building with insulation using, for example, two different output hoses 76, 80 that are positioned and operated by two different workers. Alternatively, insulation can be installed in one cavity using one of the two output hoses 76, 80, while the other of the two output hoses 76, 80 is not being utilized. Alternatively, the first and second outputs 66, 70 (or the first and second output hoses 76, 80) could be joined to a common hose or connector whereby both insulation outputs are provided to the same area by one installer, which effectively doubles the amount of insulation being provided by a single worker, in comparison with only one output 66 or 70 being utilized.

In the preferred embodiment, as illustrated by the block diagram of FIG. 3, this independent functioning and operation is achievable, in part, using a first disengage mechanism 230, such as a sprag, associated with and connected to the first feeding assembly 36 and a second disengage mechanism 240 associated with and connected to the second feeding assembly 40. Each of these two disengage mechanisms 230, 240 functions to disengage its respective feeding assembly 36, 40 from a hopper drive assembly 244 (FIG. 4) when such feeding assemblies 36, 40 are not activated or being used. With reference to the first feeding assembly 36 and with the understanding that the second feeding assembly 40 works in a comparable way, the first disengage mechanism 230 functions to cause a disengagement from the hopper drive assembly 244 when the third output shaft 56*c* of the first feeding assembly 36 is no longer rotating due to deactivation of the first feeding assembly 36. As a result, the first disengage mechanism 230 effectively disconnects or disengages the first feeding assembly 36 from the hopper drive assembly 244. Thus, when one of the two feeding assemblies 36, 40 is being operated, while the other feeding assembly 36, 40 has ceased operation, the hopper drive assembly 244 continues to move or operate thereby causing movement, in the illustrated embodiment, of both the first and second augers 38, 42 of the upper and lower hoppers 28, 32, respectively. For example, with the hopper drive assembly 244 being disengaged from the first feeding assembly 36 by means of the first disengage mechanism 230, the hopper drive assembly 244 continues to be driven by the second feeding assembly 40 since it remains activated in this example. Furthermore, due to the disengagement, there is no binding or other interference due to the de-activation or stopping of the first feeding assembly 36. Similarly, when the second feeding assembly 40 is not being used, it is disengaged from the hopper drive assembly 244 by the second disengage mechanism 240; however, the hopper drive assembly 244 can continue to be driven using the first feeding assembly 40 when it is still being used.

The block diagram of FIG. 3. also illustrates certain power and/or control elements including a battery 250 that provides electrical power for the machine 20 including the engine 100. A number of control units 260, 270, 280, 290 are also depicted in operative association with components of the machine 20, which are involved in controlling the supplying of insulation to the cavity or cavities being filled at any instant in time through the first and second output hoses 76, 80. In particular, the first switch control unit 260 is operably associated with the first air blowing assembly 84 in connection with allowing delivery of pressurized air through the first air hose 92 to the first feeding assembly 36. When the first switch control unit 260 is turned on or activated, such pressurized air is being provided to the first feeding assembly 36. Conversely, no such pressurized air is received by the first feeding assembly 36 when the first switch control unit 260 is turned off. The second switch control unit 270 is operably associated with the first clutch device 144. When the second switch control unit is turned on by the operator, the first clutch device 144 enables rotational movement of the first main shaft 140 to be coupled through the previously noted connection devices or components to the first feeding assembly drive mechanism 160 whereby the conveying mechanisms thereof operate or move in connection with the downward movement of insulation material. When the second switch control unit 270 is turned off, such mechanisms do not rotate. The third switch control unit 280 is operatively associated with the second air blowing assembly 88 and functions like the first switch control unit 260. Similarly, the fourth switch control unit 290 is operatively associated with the second clutch device 200 and functions like the first clutch device 144 but in connection with the second feeding assembly 40.

In accordance with a usual manner of operation, the operator(s) or worker(s) start the engine 100 and activate or turn on each of the four switch control units 260–290 after the hopper assembly 24 has been sufficiently filled with insulation material. Such activation results in a number of operations and movement of parts including the hopper drive assembly 244 causing movement of the first and second augers 38, 42 of the upper and lower hoppers 28, 32, respectively. This results in movement of the insulation material through the common opening at the bottom of the lower hopper 32 into each of the first and second feeding assemblies 36, 40 through their respective inlets 48, 52. Because they have also been turned on, the first and second air blowing assemblies 84, 88 deliver pressurized air to their respective first and second feeding assemblies 36, 40. As the tines or other conveying mechanisms in the feeding assemblies 36, 40 assist or facilitate movement of the insulation material downwardly and towards the first and second outputs 66, 70 of the first and second feeding assemblies 36, 40, the pressurized air from the two air blowing assemblies 84, 88 push the insulation into the first and second outputs 66, 70 and through the first and second output hoses 76, 80. The workers holding the hoses 76, 80 can have them positioned in two different cavities so that insulation material is delivered to the two different cavities at the same time when this dual operation is being provided.

Alternatively, only one of the two output hoses 76, 80 can supply insulation material at any instance in time, while operation using the other of the two output hoses 76, 80 is stopped. Assuming that the third and fourth switch control units 280, 290 have been deactivated or turned off the second disengage mechanism 240 operates to effectively operatively disassociate the second feeding assembly 40 from the hopper drive assembly 244. Consequently, the stoppage of the output shafts 60*a*, 60*b*, 60cof the second feeding assembly 40 do not negatively impact the functioning of the hopper drive assembly 244. The hopper drive assembly 244 continues to operate or drive the first and second augers 38, 42 by means of its connection to one or more of the first feeding output shafts 56*a*, 56*b*, 56*c*, such as the first feeding output shaft 56*c*as shown in FIG. 4.

Additionally, the second clutch device 200 is used in decoupling rotational movement of the second main shaft 188 to the second feeding assembly drive mechanism 216 so that the conveying mechanisms of the second feeding assembly 40 do not move or stop rotational operation. The second air blowing assembly 88, due to the turning off of the third switch control unit 280, is not delivering pressurized air to the second feeding assembly 40. Conversely, because the first of second switch control units 260, 270 remain activated, pressurized air is being delivered to the first feeding assembly 36 by means of the first air blowing assembly 84 and the first clutch device 144 couples rotational movement of the first main shaft 140 to the first feeding assembly 36 thereby causing movement of the conveying mechanisms thereof.

With regard to maintaining a desired size of the single machine 20, the various components are arranged to optimize space usage and provide the necessary interconnections. In the exemplary embodiment, the single engine 100 is utilized having the first and second air blowing assemblies 84, 88 are immediately next to each other and their lengths extend along a side of the machine 20, i.e. as the length of one air blowing assembly 84, 88 ends, the length of the other begins. The first and second feeding assemblies 36, 40 are immediately adjacent to each other at one end of the machine 20. The first and second output hoses 76, 80 extend from their respective feeding assemblies 36, 40 at one end of the machine 20. On the other hand, the present invention contemplates different implementations including more than two output hoses and a comparable number of feeding assemblies and/or air blowing assemblies. A number of engines could be employed, with each having one shaft. Currently existing single output hose machines could be modified to provide the multiple output hose operation. In that regard, the hopper assembly of such a single machine could be modified by enlarging its size to accommodate the operation in which the same single machine is being used by more than one worker to supply insulation to more than one cavity at the same time. While the devices and methods described herein constitute the preferred embodiments of the invention, it is to be understood that the invention is not limited to these embodiments and that changes can be made without departing from the scope of the invention as defined in the claims.

What is claimed is:

1. A method for controlling the blowing of insulation into different areas of a building that is being insulated, comprising:

providing a single machine that includes: at least a first engine, a hopper assembly, first and second air blowing assemblies, first and second feeding assemblies, with said first feeding assembly having a first output and said second feeding assembly having a second output;

connecting a first hose to said first output;

connecting a second hose to said second output;

loading insulation material into said hopper assembly;

powering said first engine;

activating said first blowing assembly, said first feeding assembly and said second blowing assembly, said second feeding assembly; and manually installing insulation from at least said first output.

2. A method, as claimed in claim 1, wherein:

said installation step includes manually installing insulation from said second output.

3. A method, as claimed in claim 1, wherein:

said installing step includes installing insulation in a first area of the building using said first hose and the method further includes installing insulation in a second area of the building using said second hose.

4. A method, as claimed in claim 3, wherein:

said steps of installing insulation in the first and second areas are conducted at the same time.

5. A method, as claimed in claim 1, wherein:

said single machine includes a hopper drive assembly for use in causing movement of insulation material in said hopper assembly and a first disengage mechanism operatively connected to portions of said first feeding assembly and in which the method further includes deactivating said first feeding assembly and with said deactivating step resulting in said first disengage mechanism causing said hopper drive assembly to be disengaged from said first feeding assembly such that said first feeding assembly does not cause movement of said hopper drive assembly.

6. A method, as claimed in claim 1, further including:

deactivating said second air blowing assembly and said second feeding assembly while maintaining activation of said first air blowing assembly and said first feeding assembly.

7. A method, as claimed in claim 1, wherein:

said first feeding assembly includes at least a first moving mechanism and said hopper assembly includes at least a first hopper auger and the method further includes discontinuing movement of said first moving mechanism of said first feeding assembly while continuing movement of said first auger of said first hopper assembly.

8. A method, as claimed in claim 1, wherein:

said single machine includes a hopper drive assembly and said hopper assembly includes at least a first auger, with said hopper drive assembly operatively interconnected to said first feeding assembly and said first auger, and the method includes disengaging said first feeding assembly from said hopper drive assembly such that said hopper drive assembly continues to cause movement of said first auger.

9. A single insulation blowing machine, comprising:

a hopper assembly;

a first feeder assembly having a first output;

a second feeder assembly having a second output;

a hopper drive assembly operably connected to said hopper assembly, said first feeder assembly and said second feeder assembly;

a first air blowing assembly operably associated with said first feeder assembly;

a second air blowing assembly operably associated with said second feeder assembly;

at least a first engine that is used in powering said first and second feeder assemblies and said first and second air blowing assemblies;

connection devices for operatively connecting said first engine to at least said first feeding assembly and said first air blowing assembly;

a first output hose connected to said first feeding assembly; and a second output hose connected to said second feeding assembly;

wherein said first output hose supplies insulation material for insulating a first area of a building and said second output hose supplies insulation material for insulating a second area of the building at the same time said first output hose is supplying insulation material to the building first area.

10. A single machine, as claimed in claim 9, wherein:

said first engine is a single engine having first and second output shafts in which said single engine provides power for operating said second feeding assembly when said first feeding assembly is deactivated.

11. A single machine, as claimed in claim 9, wherein:

said connection devices include a first disengage mechanism and said hopper assembly includes a least a first auger, said first disengage mechanism being connected to said first feeding assembly and said hopper drive assembly and with said hopper drive assembly also connected to said first auger and in which, when said first feeding assembly is deactivated, said first auger is caused to move using said second feeding assembly and said hopper drive assembly.

12. A single machine, as claimed in claim 11, wherein:

said first feeding assembly includes an output shaft and said first disengage mechanism is located adjacent thereto.

13. A single machine, as claimed in claim 9, wherein:

said first engine includes a first output shaft and said connection devices include a first output shaft belt and an engine first pulley in operative engagement, and with said engine first pulley connected to a first main shaft for use in operating said first feeding assembly, with a second air blowing pulley connected to said engine first pulley and a second air blowing belt in operative engagement with said second air blowing assembly for use in causing said second air blowing assembly to output pressurized air.

14. A single engine, as claimed in claim 13, wherein:

said engine includes a second output shaft and said connection devices include a second output shaft belt and an engine second pulley in operative engagement, and with a second main shaft interconnecting said engine second pulley and a first air blowing pulley, said first air blowing pulley being operatively connected to said first air blowing assembly that outputs pressurized air to said first feeding assembly.

15. A single machine, as claimed in claim 9, wherein:

said hopper assembly includes a first auger and a second auger, with said second auger being located below said first auger and being substantially parallel thereto.

16. A single machine, as claimed in claim 15, wherein:

said hopper assembly includes an upper hopper and a lower hopper that contain said first auger and said second auger, respectively, and with said upper hopper having a length greater than a length of said lower hopper.

17. A single machine, as claimed in claim 9, wherein:

said first and second feed assemblies include first and second inlets and with a common wall between said first and second inlets, said hopper assembly having a common opening for passing insulation material to first and second inlets.

* * * * *

UNITED STATES PATENT AND TRADEMARK OFFICE

CERTIFICATE OF CORRECTION

PATENT NO. : 6,796,748 B1
DATED : September 28, 2004
INVENTOR(S) : Henry Serber

It is certified that error appears in the above-identified patent and that said Letters Patent is hereby corrected as shown below:

The figures should be as indicated on the attached 8 sheets.

Signed and Sealed this

Eighth Day of February, 2005

JON W. DUDAS
*Director of the United States Patent and Trademark Office*